US012402662B2

(12) United States Patent
Potter

(10) Patent No.: US 12,402,662 B2
(45) Date of Patent: Sep. 2, 2025

(54) VAPOR PROVISION DEVICE

(71) Applicant: NICOVENTURES TRADING LIMITED, London (GB)

(72) Inventor: Mark Potter, London (GB)

(73) Assignee: NICOVENTURES TRADING LIMITED, London (GB)

( * ) Notice: Subject to any disclaimer, the term of this patent is extended or adjusted under 35 U.S.C. 154(b) by 851 days.

(21) Appl. No.: 17/250,297

(22) PCT Filed: Jun. 27, 2019

(86) PCT No.: PCT/GB2019/051821
§ 371 (c)(1),
(2) Date: Dec. 29, 2020

(87) PCT Pub. No.: WO2020/002924
PCT Pub. Date: Jan. 2, 2020

(65) Prior Publication Data

US 2021/0274846 A1 Sep. 9, 2021

(30) Foreign Application Priority Data

Jun. 29, 2018 (GB) ..... 1810714

(51) Int. Cl.
*A24F 40/485* (2020.01)
*A24F 40/10* (2020.01)
*A24F 40/51* (2020.01)

(52) U.S. Cl.
CPC ..... *A24F 40/485* (2020.01); *A24F 40/51* (2020.01); *A24F 40/10* (2020.01)

(58) Field of Classification Search
None
See application file for complete search history.

(56) References Cited

U.S. PATENT DOCUMENTS

2015/0245658 A1 9/2015 Worm et al.
2015/0282527 A1 10/2015 Henry
(Continued)

FOREIGN PATENT DOCUMENTS

CN 204499490 U 7/2015
CN 105768233 A 7/2016
(Continued)

OTHER PUBLICATIONS

"International Preliminary Report on Patentability for Application No. PCT/GB2019/051821, mailed on Jan. 7, 2021", 8 pages.
(Continued)

*Primary Examiner* — Linda L Gray
(74) *Attorney, Agent, or Firm* — Merchant & Gould P.C.

(57) ABSTRACT

A vapor provision device includes a primary airflow path, internal to the vapor provision device, from an air inlet to an air outlet, wherein air is drawn from the air inlet in a downstream direction through the primary airflow path to the air outlet by user inhalation. The device further includes a vaporizer for providing vapor into the primary airflow path, wherein the vaporizer is located within or adjacent to the primary airflow path, and a trap located in the primary airflow path to inhibit the flow of liquid along the primary airflow path in an upstream direction from the trap by retaining liquid.

10 Claims, 5 Drawing Sheets

(56) References Cited

U.S. PATENT DOCUMENTS

| | | | |
|---|---|---|---|
| 2017/0055586 | A1 | 3/2017 | Liu |
| 2017/0112192 | A1 | 4/2017 | Shan |
| 2018/0116289 | A1 | 5/2018 | Qiu |
| 2018/0169357 | A1 | 6/2018 | Reevell |

FOREIGN PATENT DOCUMENTS

| | | | |
|---|---|---|---|
| CN | 105852222 | A | 8/2016 |
| CN | 106102489 | A | 11/2016 |
| CN | 106263043 | A | 1/2017 |
| CN | 206079029 | U | 4/2017 |
| CN | 106998812 | A | 8/2017 |
| CN | 107568797 | A | 1/2018 |
| CN | 207100509 | U | 3/2018 |
| CN | 107865462 | A | 4/2018 |
| GB | 191019132 | A | 7/1911 |
| GB | 2568718 | A | 5/2019 |
| JP | 2016037853 | A | 3/2016 |
| JP | 2017502684 | A | 1/2017 |
| JP | 2017506901 | A | 3/2017 |
| JP | 2017537634 | A | 12/2017 |
| JP | 2018512117 | A | 5/2018 |
| JP | 2021529508 | A | 11/2021 |
| KR | 20160147258 | A | 12/2016 |
| RU | 2646737 | C2 | 3/2018 |
| WO | 2015120591 | A1 | 8/2015 |
| WO | 2015149311 | A1 | 10/2015 |
| WO | WO2015165812 | A1 * | 11/2015 ..... A24B 15/167 |
| WO | 2017051150 | A1 | 3/2017 |
| WO | 2017109448 | A2 | 6/2017 |
| WO | 2017211137 | A1 | 12/2017 |
| WO | 2017216516 | A1 | 12/2017 |
| WO | 2018037206 | A1 | 3/2018 |
| WO | 2018055334 | A1 | 3/2018 |

OTHER PUBLICATIONS

"International Search Report and Written Opinion received for PCT Patent Application No. PCT/GB2019/051821, mailed on Oct. 2, 2019.", 12 pages.

"Office Action received for Russian Patent Application No. 2020142940, mailed on Jun. 28, 2021", 10 pages.

"Reasons for Rejection received for Japanese Patent Application No. 2020-567257, mailed on Mar. 1, 2022", 12 pages (06 pages of English Translation and 06 pages of Official Copy Only).

"Office Action received for Chinese Patent Application No. 201980042905.6, mailed on May 8, 2024", 19 pages (7 pages of English Translation and 12 pages of Official Copy).

"Reasons for Refusal received for Japanese Patent Application No. 2023-017614, mailed on Nov. 21, 2023", 13 pages (6 pages of English Translation and 7 pages of Official Copy).

* cited by examiner

VAPOR PROVISION DEVICE

PRIORITY CLAIM

The present application is a National Phase entry of PCT Application No. PCT/GB2019/051821, filed Jun. 27, 2019, which claims priority from GB Patent Application No. 1810714.4, filed Jun. 29, 2018, each of which is hereby fully incorporated herein by reference.

FIELD

The present disclosure relates to a vapor provision device, for example, a nicotine delivery system, an electronic cigarette, and the like.

BACKGROUND

Electronic vapor provision systems, such as electronic cigarettes (e-cigarettes), generally contain a reservoir of vapor precursor. The vapor precursor may be provided as a liquid containing a formulation, typically including nicotine, from which a vapor is generated for inhalation by a user. In other types of vapor provision system, sometimes referred to as hybrid devices, tobacco or another flavor element may be provided separately from the vapor precursor.

A vapor provision system usually comprises a vapor generation chamber containing a vaporizer, for example, a heating element, which is arranged to vaporize a portion of the precursor. As a user inhales on a mouthpiece of the e-cigarette and electrical power is supplied to the vaporizer, air is drawn into the e-cigarette through an inlet hole and flows along a path into the vapor generation chamber, where the air mixes with the vapor produced by the vaporizer to form an aerosol. The air drawn through the vapor generation chamber continues along a path to, and out through, the mouthpiece, carrying the vapor with it for inhalation by the user.

For electronic cigarettes using a liquid vapor precursor (e-liquid), there is a risk of the liquid leaking out of the device. For example, many liquid-based e-cigarettes have a capillary wick for transporting liquid (vapor precursor) from the reservoir to the vaporizer. The liquid may leak from the junction or interface between the wick and the liquid reservoir and/or from the wick itself. Liquid may also form from vapor that condenses while still within the e-cigarette. Such liquid may impair or damage components of the e-cigarette, for example, by corroding components or impacting electrical operation within the device. In other cases, the build-up of liquid at certain locations within the e-cigarette may impair the ability of the device to operate as intended. Furthermore, liquid may leak out of the e-cigarette, whether through the mouthpiece and/or any other opening (such as an air inlet hole). This leakage may be perceived as a quality defect by users, and it is generally undesirable for the liquid to contact the skin or clothing of a user. Therefore it would be advantageous to prevent or at least reduce the level of such liquid leakage within and/or from an electronic vapor provision system.

SUMMARY

A vapor provision device disclosed herein comprises a primary airflow path, internal to the vapor provision device, from an air inlet to an air outlet, wherein air is drawn from the air inlet in a downstream direction through the primary airflow path to the air outlet by user inhalation. The device further comprises a vaporizer for providing vapor into the primary airflow path, wherein the vaporizer is located within or adjacent to the primary airflow path, and a trap located in the primary airflow path to inhibit the flow of liquid along the primary airflow path in an upstream direction from the trap by retaining liquid.

Also provided is a non-therapeutic method of operating a vapor provision device comprising: providing a primary airflow path, internal to the vapor provision device, from an air inlet to an air outlet; drawing air from the air inlet in a downstream direction through the primary airflow path to the air outlet by user inhalation; providing vapor into the primary airflow path; and retaining liquid in a trap located in the primary airflow path to inhibit the flow of liquid along the primary airflow path in an upstream direction from the trap.

BRIEF DESCRIPTION OF THE DRAWINGS

Various example implementations of the approach disclosed herein will now be described, by way of example only, with reference to the accompanying drawings, in which.

DETAILED DESCRIPTION

The present disclosure relates to a vapor provision device, also referred to as an aerosol provision system, an e-cigarette, a vapor provision system, and similar. In the following description, the terms "e-cigarette" and "electronic cigarette" are generally used interchangeably with (electronic) vapor provision system/device, unless otherwise clear from the context. Likewise, the terms "vapor" and "aerosol", and related terms such as "vaporize", "volatilize" and "aerosolize", are generally used interchangeably, unless otherwise clear from the context.

Vapor provision systems (e-cigarettes) often have a modular design including, for example, a reusable module (a control or device unit) and a replaceable (disposable) cartridge module. The replaceable cartridge part typically comprises the vapor precursor and the vaporizer (and hence is sometimes referred to as a cartomizer), while the reusable module typically comprises the power supply, for example a rechargeable battery, and control circuitry. It will be appreciated these modules may comprise further elements depending on functionality. For example, the reusable control part may comprise a user interface for receiving user input and displaying operating status characteristics, and the replaceable cartridge part may comprise a temperature sensor for use in helping to control temperature. In operation, the cartridge is typically electrically and mechanically coupled (in removable fashion) to the control unit using (for example) a screw thread, latching or bayonet fixing with appropriately engaging electrical contacts. When the vapor precursor in the cartridge is exhausted, or the user wishes to switch to a different cartridge (perhaps having a different vapor precursor or flavor), the cartridge may be removed (detached) from the control unit and a replacement cartridge attached in its place. Devices conforming to this type of two-part modular configuration may be referred to as a two-part device.

Many of the examples described herein comprise a two-part device employing disposable cartridges and having an elongated shape. Nevertheless, it will be appreciated that some e-cigarettes may have more modules, e.g. separate modules for the vapor precursor reservoir and the vaporizer respectively, while some e-cigarettes may be formed as a single integrated system. The approach described herein may generally be adopted for a wide range of electronic cigarette configurations, including one-part devices as well as modular devices comprising two or more parts, refillable devices and single-use disposable devices, likewise for devices conforming to a variety of overall shapes, including so-called box-mod high performance devices that typically have a more box-like shape (rather than being elongated).

Figure 1:
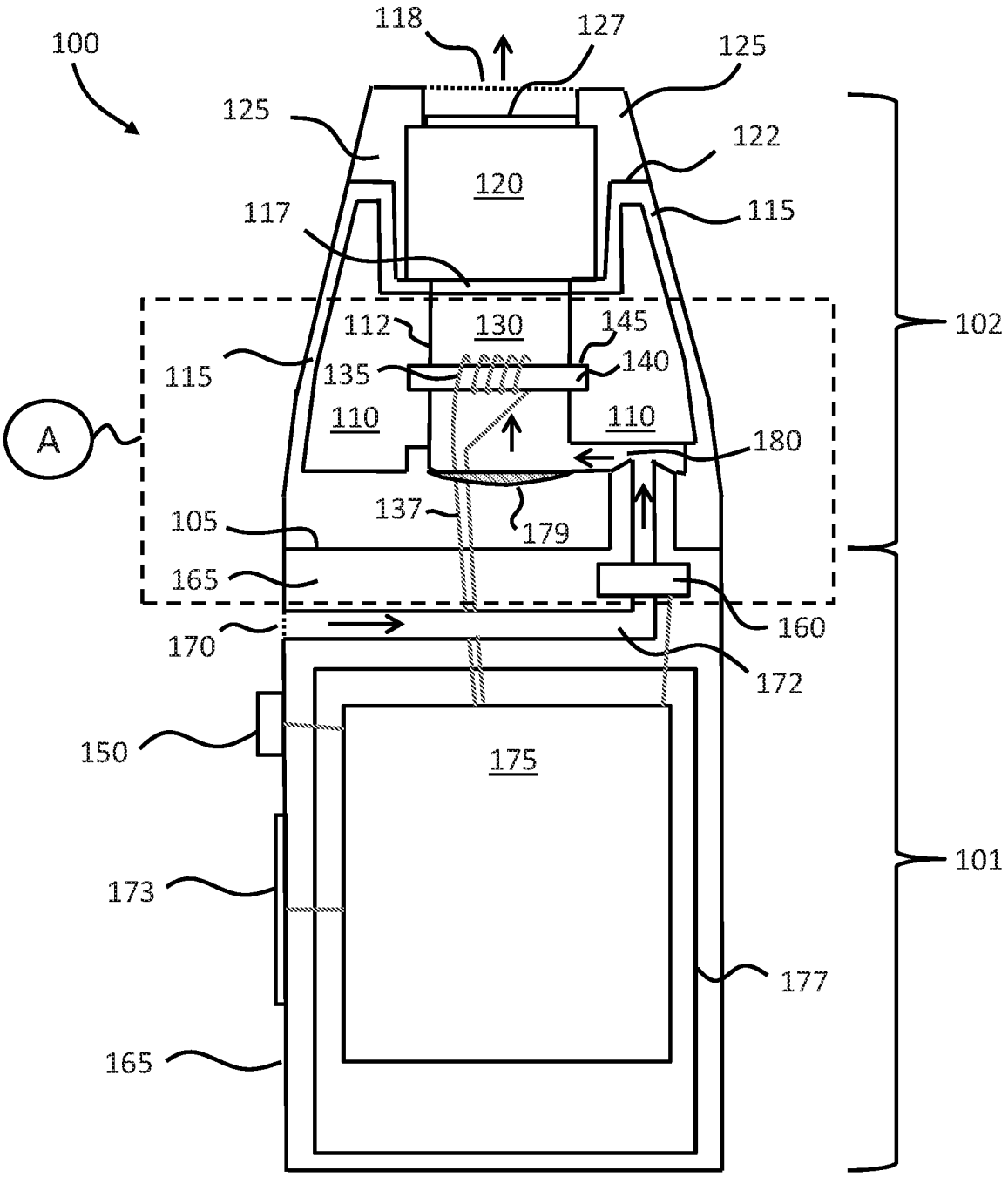
FIG. 1 is a schematic cross-section of a vapor provision device according to an implementation of the disclosure.

FIG. 1 is a cross-sectional view through an example e-cigarette 100. The e-cigarette 100 comprises two main components or modules, namely a reusable/control unit 101 and a replaceable/disposable cartridge 102. In normal use the reusable part 101 and the cartridge 102 are releasably coupled together at an interface 105. When the cartridge 101 is exhausted or the user wishes to switch to a different cartridge, the cartridge 102 may be removed from the reusable part 101 and a replacement cartridge 102 attached to the reusable part 101 in its place. The interface 105 generally provides a structural, electrical and air path connection between the two parts 101, 102 and may utilize a latch mechanism, bayonet fixing or any other form of mechanical coupling as appropriate. The interface 105 typically also provides an electrical coupling between the two parts, which may be wired using connectors, or may be wireless, for example, based on induction.

In FIG. 1, the cartridge 102 comprises a reservoir 110 for containing a liquid vapor precursor (e.g. an e-liquid), and further comprises a chamber or container 120 for holding a solid material. In particular, the liquid container (reservoir) 110 is formed within a first portion of the outer shell or housing 115, and the solid material container 120 is formed within a second portion of the outer shell or housing 125. The outer shell 125 is further structured as a mouthpiece to provide an air outlet 118. The liquid container housing 115 and the solid material container housing 125 may be provided as one integral component, formed directly as a single unit at manufacture, or may be formed from two parts 115, 125 which are then assembled together at manufacture in a substantially permanent fashion. For example, the liquid container housing 115 and the material container housing 125 may be fixed to each other along join 122 by friction welding, spin welding, ultrasonic welding, and so on (or by any other suitable technique). The cartridge housings 115 and 125 may be formed of plastic. It will be appreciated the specific geometry of the housings 115, 125, along with their materials, sizing, etc, may vary according to the particular design of a given implementation. In some implementations, a user may be able to separate the outer shell 125, including the solid material container 120, from housing 115 and the rest of the cartridge 102, for example, in order to provide a new solid material container 120 that includes fresh tobacco or other material.

The cartridge 102 is arranged such that liquid from the reservoir 110 is volatilized to produce a vapor or aerosol, and at least some (if not all) of the aerosol/vapor then passes through the solid material in container 120 to pick up (entrain) flavor from this solid material. It will be appreciated therefore that the solid material is air permeable, at least to some extent: for example, the solid material may be granular, such as a powder, allowing air and vapor to pass through spaces between the granules.

The liquid reservoir 110 of the cartridge 102 has an outer wall provided by the cartridge housing 115 and an inner wall 112 which also defines the outside of an airflow path (airflow channel) 130 that extends along a central axis of the device (parallel to the main longitudinal axis through the cartridge 102). The liquid reservoir 110 therefore has an annular shape, such that liquid circumferentially surrounds the airflow channel 130, which passes through the liquid reservoir 110. In other implementations, the inner wall 112 of the reservoir may extend circumferentially only part-way around airflow channel 130 before engaging with the cartridge housing 115, such that at least part of the airflow channel 130 is defined by the cartridge housing 115. The liquid reservoir 110 is closed at each end by the cartridge housing 115 to retain the e-liquid in the liquid reservoir.

The cartridge 102 has a heater 135 for heating, and hence vaporizing, liquid from the reservoir 110. The heater 135 may be, for example, an electrically resistive heater, a ceramic heater, an induction heater, or any other suitable such facility. FIG. 1 shows the heater 135 implemented as a resistive coil electrical heater. The cartridge further comprises a wick 140 which transports e-liquid from the reservoir 110 to the heater 135 for vaporization. As shown in FIG. 1, the heater 135 may be wrapped (coiled) around the wick 140 to provide good thermal contact between the heater 135 and the wick. The wick 140 is generally absorbent and acts to draw liquid from the reservoir 110 by capillary action. The wick 140 may be made of any suitable material, such as a cotton or wool or the like, a synthetic material, including for example polyester, nylon, viscose, polypropylene or the like, or a ceramic or glass material.

To allow the wick 140 to be in contact with the liquid in the reservoir 110, the wick may be inserted into the reservoir through one or more holes 145 in the inner wall 112 of the liquid container. In other cases, the inner wall 112 may include at least one porous member, such as a ceramic disk (not shown), in place of the hole 145. The at least one porous member is in contact with the wick 140 to allow liquid to pass through the inner wall 112, out of the reservoir 110, and onto the wick 140. The wick then transports the liquid towards the heater 135 for vaporization. The configuration shown in FIG. 1 has each end of the wick passing through the inner wall 112 into the reservoir 110; this configuration helps the inner wall 112 to support the wick and so retain the wick in the correct position within the airflow channel. Additionally (or alternatively), the wick 140 may be supported, at least in part, by the heater coil 135. Other configurations will be apparent to the skilled person.

In use, the cartridge 102 is attached to reusable part 101 to allow the heater 135 to receive power by wires 137 connected across interface 105 to the reusable part 101. Interface 105 is provided with electrical contacts or connectors, not shown in FIG. 1, to link wires 137 in the cartridge 102 with corresponding wires in the reusable part 101 (more generally, the wiring of FIG. 1 is shown only in schematic form, rather than indicating the detailed paths if such wiring). The device 100 may be activated by the user inhaling on mouthpiece 118, which triggers a puff detector 160 (airflow sensor) to detect the airflow or change in pressure resulting from the inhalation. Other types of device may be activated additionally or alternatively by a user pressing a button or similar on the outside of the device. In response to a puff (inhalation) detected by the puff detector 160, the reusable part 101 provides electrical power to activate the heater 135 to volatilize or vaporize the liquid in the wick 140. The vapor or aerosol thereby formed in airflow channel 130 is drawn by the user inhalation into and through the solid material container 120, where it picks up flavor from the material in the container 120, before exiting through mouthpiece 118 for inhalation by the user.

As liquid is vaporized from the wick 140, further liquid is drawn into the wick by capillary action from the reservoir 110. The rate at which liquid is vaporized by the vaporizer (heater) 135 generally depends on the level of power supplied to the heater 135. Some devices allow the rate of vapor generation (vaporization rate) to be changed by a suitable control interface that alters the amount of power supplied to the heater 135 during activation. The adjustment in power level supplied from the reusable part to the heater 135 may be implemented using pulse width modulation or any other suitable control technique.

The solid material container 120 is linked to the airflow channel 130 by a first end wall 117 and (at the mouth end) by a second end wall 127. Each end wall 117, 127 is designed to retain the solid material in container 120 while allowing the passage of airflow along channel 130 and out through mouthpiece 118. This may be achieved for example by the end walls having suitably fine holes that retain the granules (or the like) of the solid material in container 120, but allow air to flow through the holes. The end walls 127 of the material container 120 may be provided by separate retainers, for example in the form of disks which are inserted into each end of the housing 125 during manufacture. As an alternative, one or both of the end walls 117, 127 may be formed directly as part of the material container 120.

The reusable part 101 comprises a housing 165 with an opening that defines one or more air inlets 170 for the e-cigarette, a battery 177 for providing operating power to the device, control circuitry 175, a user input button 150, a visual display 173, and puff detector 160. In the configuration shown in FIG. 1, the battery 177 and the control circuitry 175 have a generally planar geometry, with the battery 177 underlying the control circuitry. The housing 165 may be formed, for example, from a plastics or metallic material and has a cross-section generally conforming to the shape and size of the cartridge part 102, so as to provide a smooth outer surface at the transition between the two parts at the interface 105. The battery 177 is rechargeable and may be recharged through a USB connector (not shown in FIG. 1) in the reusable part housing 165.

The user input button 150 may be implemented in any suitable fashion, e.g. as a mechanical button, a touch-sensitive button, etc., and allows various forms of input by the user. For example, the user might use the input button 150 to switch the device off and on (whereby puff detection to activate the heater is only available when the device is switched on). The user input button 150 may also be used to perform control settings, such as adjusting the power level. The display 173 provides a user with a visual indication of various characteristics associated with the electronic cigarette, for example the current power level setting, remaining battery power, on/off status and so forth. The display may be implemented in various ways, for example, using one or more light emitting diodes (LEDS) (potentially multi-colored) and/or as a small liquid crystal display (LCD) screen. Some e-cigarettes may also provide other forms of information to a user, for example using audio signaling and/or haptic feedback.

The control circuitry 175 typically includes a processor or microcontroller (or similar) which is programmed or otherwise configured to control the operations of the electronic cigarette 100. For example, the control circuitry 175 is responsive to a puff detection from puff detector 160 to supply electrical power from the battery 177 to the heater/vaporizer 135 through wires 137 to generate vapor for user inhalation. The control circuitry can also monitor additional states within the device, such as the battery power level, and provide a corresponding output via display 173.

In the e-cigarette 100 shown in FIG. 1, air inlet 170 connects to an airflow path 172 through the reusable part 101. The air pathway 172 of the reusable part 101 in turn connects into the cartridge via the interface 105 when the reusable part 101 and cartridge part 102 are connected together, and hence feeds into airflow channel 130. The puff detector (sensor) 160 is placed within or adjacent to the airflow pathway 172 of the reusable part 101 to inform the control circuitry 175 when a user inhales on the device 100. The combination of the air inlet 170, airflow pathway 172, airflow channel 130 and mouthpiece 118 can be considered to form or represent the primary airflow path of the e-cigarette 100, whereby the airflow resulting from a user inhalation travels in the direction indicated by the arrows in FIG. 1, from air inlet 170 (upstream) to the mouthpiece 118 (downstream).

In some devices, liquid leakage may occur, for example, from the wick 140 and/or from the reservoir 110 (and/or from the join between the two, such as holes 145). Another possible source of leakage is that vapor generated by heater 135 may re-condense in the airflow channel 130, rather than exiting the e-cigarette in vapor form via mouthpiece 118. The puff sensor 160, which is located on the primary airflow path through the device, may be vulnerable to damage or impaired operation caused by contact with such leaked e-liquid. For example, the leaked liquid may propagate along the primary airflow path (in an upstream direction, i.e. opposite to the normal airflow direction during a user inhalation) and cause corrosion or other damage to external and/or internal components of the puff sensor 160 (including wires and the like for connecting the puff sensor 160 to the control circuitry 175). Another possibility is that liquid may accumulate on the surface of the puff sensor 160, and this may isolate the puff sensor from the airflow pathway 172 by forming a layer over the surface of the puff sensor. As a result, the puff detector 160 may suffer reduced sensitivity to changes in the airflow, and so it may be more difficult (if not impossible) to activate the e-cigarette by inhalation.

Leaked e-liquid may cause other problems in the e-cigarette, in addition to or instead of impairing the operation of the puff detector 160 as described above. For example, the liquid may potentially leak out of the e-cigarette, such as via mouthpiece 118, via air inlet 170, and/or at the interface 105 between the cartridge 102 and control unit 101 (particularly when the cartridge 102 and the control unit 101 are separated, such as to replace the cartridge). Apart from giving the impression of poor product quality, such liquid leakage may potentially cause discomfort or irritation to the skin of a user, and/or stain clothing (depending upon the particular formulation of the e-liquid).

Accordingly, the e-cigarette 100 or vapor device described herein is provided with certain features to try to trap or restrain the movement of liquid that may leak into (or is formed within) the airflow channel 130. For example, the airflow channel 130 includes a section of convoluted pathway 180 located between the airflow sensor 160 and the vaporizer 135. The convoluted pathway is part of the primary airflow path for the device, and typically includes at least two bends, each bend having (turning) an angle of ninety degrees or more. The convoluted air pathway 180 shown in FIG. 1 ensures there is no simple, direct pathway (e.g. line-of-sight) between (i) the puff sensor 160, and (ii) the vaporizer 135 and wick 140 (and the wick openings 145 in the inner wall 112).

The primary airflow path may also include a sump (pool or recess) 179. The sump 179 helps to retain liquid that leaks from the wick 140 or associated components and travels upstream along the primary airflow path (opposite to the airflow direction). It will be appreciated that in normal use, the mouthpiece will generally be held in a raised position with respect to the remainder of the e-cigarette 100; consequently, any liquid that leaks from the wick 140 or reservoir 110 (or that is formed by condensation downstream of the vaporizer) will tend to flow or fall, under gravity, down airflow channel 130 towards sump 179. This liquid will then collect in sump 179, which acts as a form of trap for the liquid, helping to prevent the liquid from flowing further down the airflow channel 130 towards the puff sensor 160. As will described in more detail below, convoluted pathway 180 can likewise be considered as a form of trap to prevent or inhibit liquid from flowing further down the airflow channel 130 towards the puff sensor 160.

FIGS. 2 to 8 provide further examples of devices that include a convoluted section 180 and/or a liquid sump 179 as traps in the primary airflow channel. It will be appreciated that the designs of these various examples may be implemented in the electronic cigarette of FIG. 1, or in any other e-cigarette or vapor provision device as appropriate in which liquid leakage may be a potential concern.

In particular, FIGS. 2-8 schematically show a cross-section of a portion of an electronic cigarette or vapor provision device 100 such as shown in FIG. 1. The illustrated portion includes the section of the primary airflow path from the puff sensor 160 to (and slightly past) the wick 140 and the heater 135. Note that the illustrated portion depicted in FIGS. 2-8 corresponds generally to the portion of FIG. 1 identified by the dashed-box labelled A. Thus this portion of the electronic cigarette 100 includes at least parts of the cartridge housing 115, the control portion housing 165, and the liquid reservoir 110, as well as the wick 140 and vaporizer (heating coil) 135. The illustrated portion of the electronic cigarette further includes the part of the inner wall 112 of the liquid reservoir 110 having one or more openings 145 through which the wick 140 is coupled to the liquid reservoir 110. The illustrated portion of the electronic cigarette shown in FIGS. 2-8 further includes a section of the primary airflow path that runs from the air inlet 170 to the mouthpiece acting as an air outlet 118 in the direction shown by the arrows (the air inlet 170 and air outlet 118 are not shown in FIGS. 2-8). Note that these airflow arrows of FIGS. 2-8 can be considered as representing the predominant, average (for example, mean) or net airflow direction at the indicated locations.

As shown in FIGS. 2-8, the heater 135 is located on the primary airflow path and is coupled by the wick 140 to the liquid reservoir 110 to allow the heater 135 to vaporize liquid from the reservoir 110. The airflow sensor (puff detector) 160 is also located on the primary airflow path upstream of the heater 135 for detecting inhalation by a user on the mouthpiece in order to activate the heater. In the examples shown, the shape of the primary airflow path is largely defined by walls of the reusable part housing 165, the cartridge part housing 115, and the inner wall 112 of the liquid reservoir 110. However, an e-cigarette may utilize other components or structures as appropriate to define a suitable primary airflow path according to the requirements of any given implementation.

Figure 2:
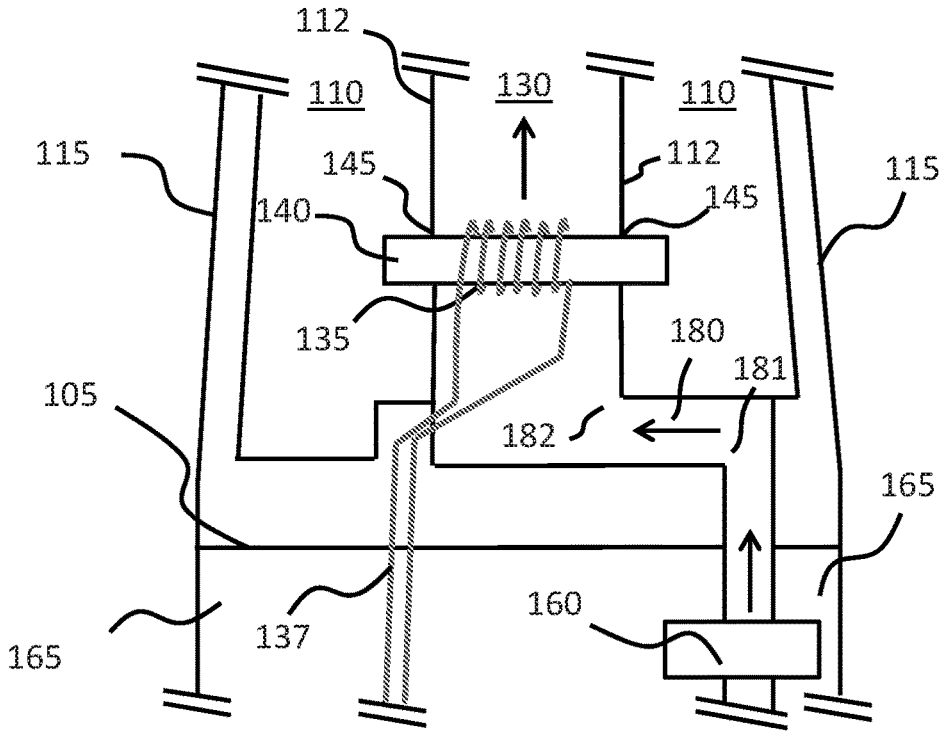
FIG. 2 is a schematic cross-section of a portion of a vapor provision device similar to that shown in FIG. 1, and including a convoluted air pathway.

With reference now to the particular configuration of FIG. 2, the primary airflow path from the airflow sensor (puff detector) 160 to the heater (vaporizer) 135 comprises a convoluted section 180 including first and second bends 181, 182. If we denote the top of the mouthpiece as the top of the overall e-cigarette 100, the airflow shown in FIG. 2 goes upwards (i.e. flows towards the top) from the puff detector 160, before turning approximately 90 degrees at the first bend 181 to flow sideways (inwards, towards the center of the device). The airflow turns again at the second bend 182, once more by approximately 90 degrees, to return to an original upwards flow direction along the airflow channel 130. In other words, the turn or rotation of the second bend 182 is opposite to the turn or rotation of the first bend 181, so that they can be seen to cancel one another out—i.e. the original airflow direction on entering the convoluted section 180 is maintained for the airflow direction on exiting the convoluted section (albeit the exiting airflow has been shifted slightly sideways, towards the center of the device, compared with the entering airflow).

Accordingly, we can consider the primary airflow path to extend in a first direction (vector) from the airflow sensor 160 to the first bend 181, in a second direction (vector) between the first bend 181 and the second bend 182, and in a third direction (vector) from the second bend 182 towards the vaporizer 135. The directions denote the downstream direction of (average or net) airflow in the corresponding sections of the primary airflow path. The first and third directions are parallel with one another, whereas the second direction is perpendicular to the first and third directions. The airflows of the first and third directions, although parallel, are laterally offset from one another (by an amount corresponding to the distance travelled by the airflow in the second direction).

The first and second bends 181, 182 form a convoluted passage 180 in the primary airflow path, which acts as a form of trap to impede liquid from travelling upstream of the trap (convoluted passage 180) towards the puff detector 160. In particular, air travels without difficulty downstream from the puff detector 160, through the convoluted section 180, to the vaporizer 135 due to a pressure differential between the air inlet 172 (generally atmospheric) and the mouthpiece 118 (less than atmospheric because of the user inhalation). In contrast, any liquid in the device tends to move (fall) under the influence of gravity, since the weight of the liquid generally overcomes the pressure differential arising from the user inhalation. Given the normal orientation during use of an e-cigarette, with the mouthpiece 118 at the top, this gravitational influence causes any free liquid to travel in the opposite direction to the air, i.e. the liquid tends to fall in an upstream direction from the vaporizer 135 towards the puff detector 160. The convoluted passage 180 acts to impede this gravity-driven motion of the liquid. For example, the portion of the convoluted passage 180 between the first and second bends 181, 182 in FIG. 2 is approximately horizontal, and so acts as a barrier or inhibitor (or trap) for such gravity-driven movement along the primary airflow channel. This convoluted section 180 therefore helps to reduce the risk (or amount) of liquid from the vaporizer reaching, and potentially damaging, the puff sensor 160. Likewise, the convoluted section 180 also helps to reduce the risk (or amount) of liquid exiting the e-cigarette at air inlet 170. In addition, because the convoluted passage 180 is located downstream of the interface 105 (in the airflow direction), the convoluted passage 180 further helps to reduce the risk (or amount) of liquid exiting the e-cigarette at interface 105 (especially when the reusable part 101 is detached from the cartridge 102).

Although each of the first and second bends 181, 182 is shown in FIG. 2 as a sharp (rectangular) corner, it will be appreciated that either or both of these bends may be implemented by a curved, rounded or generally more gradual change of direction. Furthermore, although the first and second bends 181, 182 are shown in FIG. 2 as separated by a short portion of sideways flow, in other implementations, the first and second bends may be directly connected to one another 181, 182, for example, to provide a continuous change of direction—first one way, and then the opposite way. Alternatively, in some implementations, additional bends or changes of direction may be located between bends 181 and 182.

Referring now to FIG. 3, this again shows schematically a cross-section of a portion of an electronic cigarette. Many aspects of FIG. 3 match corresponding aspects of FIG. 2, and hence are not described in detail again in the interest of brevity. However, whereas in the example of FIG. 2 the first and second bends each turn an angle of approximately ninety degrees, in the example of FIG. 3, both the first and second bends 181 and 182 turn an angle of approximately one hundred and eighty degrees.

Figure 3:
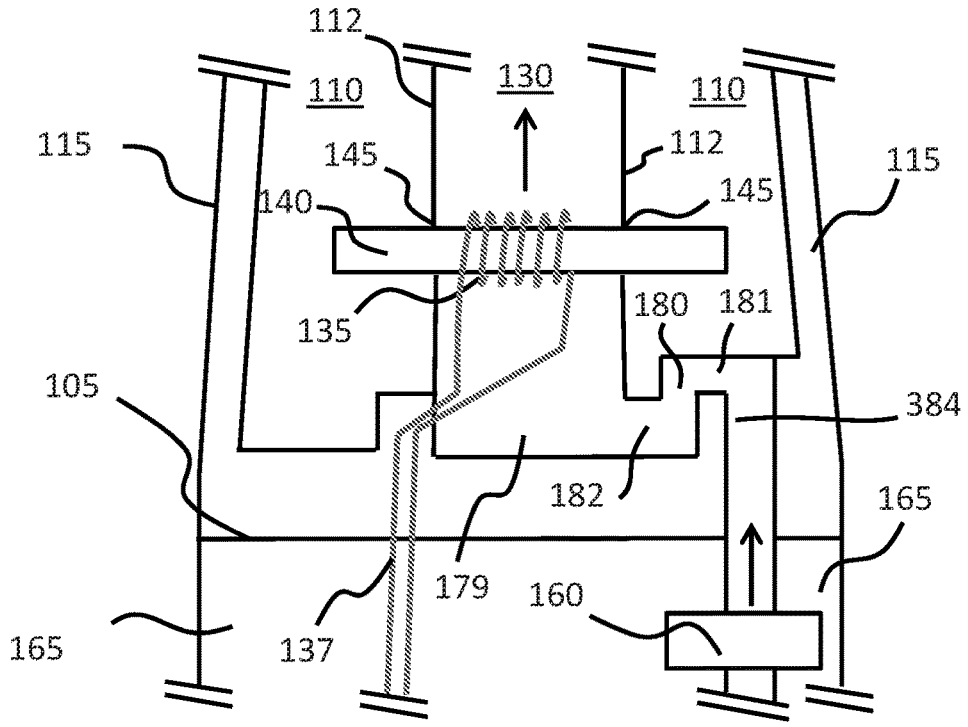
FIG. 3 is a schematic cross-section of a portion of another vapor provision device similar to that shown in FIG. 1, and including a convoluted air pathway.

As in the case of FIG. 2, the angles turned by the first and second bends 181, 182 in FIG. 3 are of equal magnitude and opposite rotational direction. In other words, the angle turned by the first bend 181 is reversed by the second bend 182 so that the first direction (as defined above, leading into the convoluted section 180) is parallel to the third direction (as defined above, leading out of the convoluted section 180). Furthermore, as the first and second bends 181, 182 both turn angles of one hundred and eighty degrees, the second direction (between the first and second bends, is (approximately) antiparallel to the third direction and to the first direction (by antiparallel, it is meant that the second direction is parallel with, but opposite to, the first and third directions). As for FIG. 2, the third airflow direction is slightly offset laterally (generally towards the center of the device) compared with the first airflow direction, the amount of the offset being determined by the sizing and separation of the first and second bends 181, 182.

Note that in the implementation of FIG. 3, the first and second bends are coplanar. In other words, if the first bend 181 is regarded as a rotation of 180 degrees about a first axis, and the second bend 182 is regarded as a rotation of 180 degrees about a second axis, then the first and second axes are parallel (both perpendicular to the plane of the page for FIG. 3). However, the bends 181, 182 may not be coplanar—for example, the first and second axes might be perpendicular to one another (and both still perpendicular to the upwards direction of the device). In other cases, there may be an intermediate angle (greater than 0 and less than 90 degrees) between the two axes. In some cases, the individual bends may be non-planar, for example, they may have a more complex curvature that involves different stages of rotation about different axes.

The convoluted passage 180 of FIG. 3 provides a greater impedance to liquid travelling upstream of the vaporizer 135 (compared with the convoluted passage 180 shown in FIG. 2), in that the first and second bends 181, 182 shown in FIG. 3 define a small wall or barrier (or lip) 384, which prevents the horizontal flow of liquid that might occur in the configuration of FIG. 2. Accordingly, to navigate the convoluted section 180 in the upstream direction, any liquid must travel a certain distance upwards to overcome wall or barrier 384. It will be appreciated that gravity will generally prevent the liquid from overcoming the wall 384, at least while the e-cigarette 100 is maintained in its normal orientation for use. Furthermore, the leakage protection provided by the configuration of FIG. 3 is more robust (compared to the configuration of FIG. 2), since small changes in orientation of the device shown in FIG. 3 will generally not be effective in causing liquid to overcome the wall 384. Thus upstream travel of liquid will still be impeded in the design of FIG. 3 even if there is a certain degree of movement, for example, rotation or tilting, of the e-cigarette.

Furthermore, wall 384 can also be considered as providing a trap or sump 179 located at or near the bottom of the airflow channel 130. Thus leaked liquid may collect and stay in the trap or sump 179, at least while the device is maintained in a relatively normal orientation. This further helps to prevent any liquid leakage from causing potential damage to the internal components of the e-cigarette, and/or from exiting the e-cigarette in an undesired manner.

Figure 4:
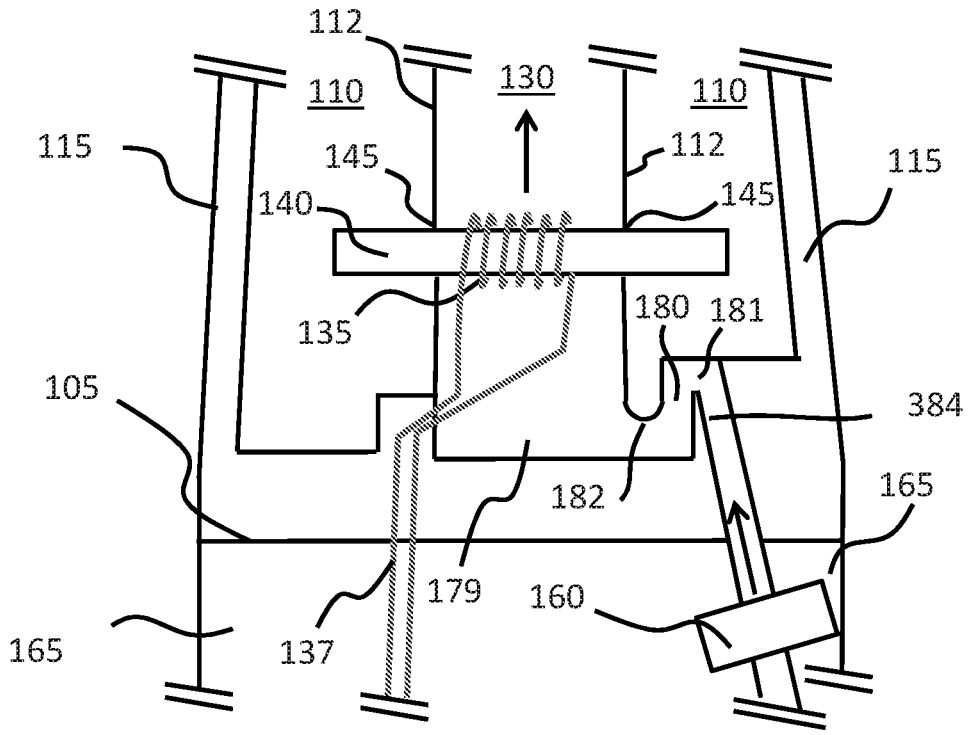
FIG. 4 is a schematic cross-section of a portion of another vapor provision device similar to that shown in FIG. 1, and including a convoluted air pathway.

In the example of FIG. 3, the second direction is antiparallel to the first and third directions; however, other implementations may have a different arrangement. Thus referring now to FIG. 4, this again schematically shows a cross-section of a portion of an electronic cigarette. Various aspects of the e-cigarette of FIG. 4 are the same as, or similar to, corresponding aspects of FIG. 2 (and/or FIG. 3), and so will not be described in detail again in the interest of brevity. However, whereas in the example of FIG. 2 the first and second bends 181, 182 both turn angles of approximately ninety degrees, and in the example of FIG. 3 the first and second bends 181, 182 both turn angles of approximately one hundred and eighty degrees, the implementation of FIG. 4 illustrates that the various directions do not need to be parallel (or antiparallel), and that the first and second bends may turn through different angles. Thus in FIG. 4, the second bend 182 turns an angle of approximately one hundred and eighty degrees, but the first bend 181 turns an angle (in the opposite direction) which is less than this—approximately one hundred and sixty degrees.

Moreover, while the third airflow direction in FIG. 4 is generally parallel to the main airflow direction of the device (as indicated in FIG. 4 by the arrow along airflow channel 130), and the second airflow direction between the first and second bends 181, 182 is generally antiparallel to this third direction, the first airflow direction, i.e. upstream of the first bend 181, is inclined (not parallel) to both the second and third airflow directions by an angle of approximately 20 degrees. This inclined direction might be adopted, for example, to help accommodate other components in the e-cigarette more easily. It will be appreciated that while FIG. 4 shows the first direction inclined to the vertical (for the normal orientation of the device), in other implementations, the second and/or third directions may also (or alternatively) be likewise inclined.

Note that in FIG. 4, the first direction is still generally upwards (towards the mouthpiece), likewise the third direction, while the second direction is generally downwards (away from the mouthpiece). This can be semi-quantified on the basis that the third airflow direction has a positive dot (inner) product with respect to the first airflow direction, whereas the second airflow direction has a negative dot product with respect to the first airflow direction and likewise with respect to the third airflow direction. Thus the second airflow direction includes a negative or reverse component with respect to the first and third airflow directions, and this can be seen to lead to the presence of the lip or rim 384 between the first and second bends 181, 182. As discussed above in relation to FIG. 3, this rim or wall 384 can be considered as providing a sump or trap 179 located at or near the bottom of the airflow channel 130. Leaked liquid may collect in the sump or trap, and stay there, at least while the device is maintained in the normal orientation, since the rim 384 provides a gravitational barrier against such liquid travelling further upstream.

Figure 5:
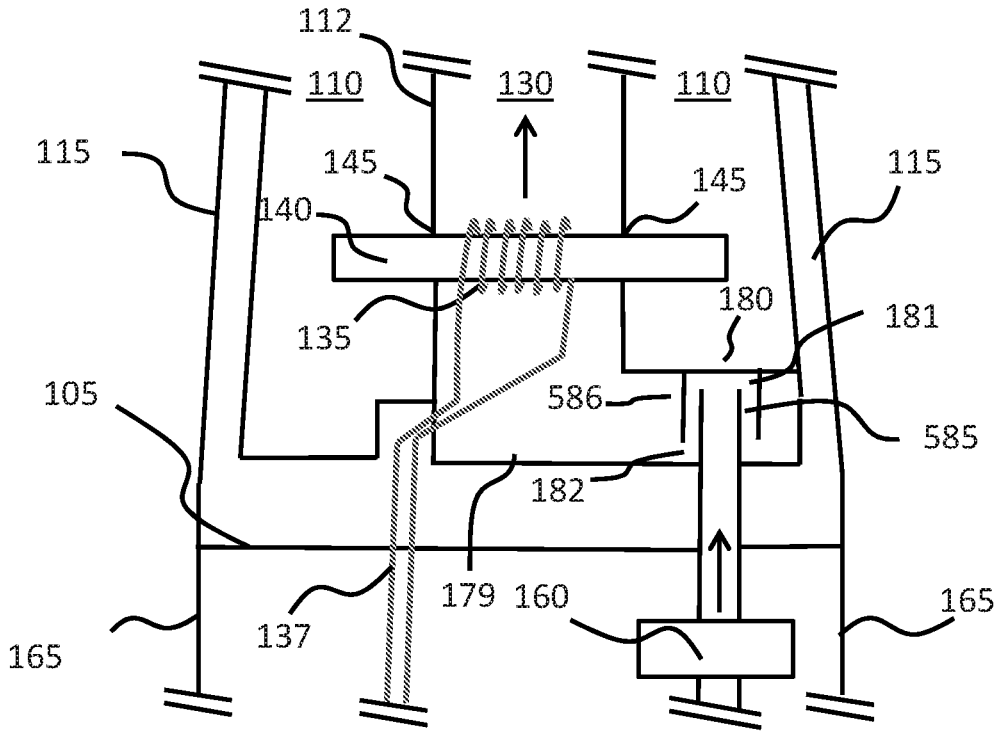
FIG. 5 is a schematic cross-section of a portion of another vapor provision device similar to that shown in FIG. 1, and including a convoluted air pathway.

Referring now to FIG. 5, this again schematically shows a cross-section of a portion of an electronic cigarette. Many aspects of FIG. 5 match corresponding aspects of FIGS. 2, 3 and/or 4, and hence are not described in detail again in the interest of brevity. In the example of FIG. 5, the convoluted path 180 is formed in effect by two tubes, a first tube 585 and a second tube 586. The first tube 585 extends in a first airflow direction upwards (towards the mouthpiece) from the puff detector 160 and into the second tube 586. The first bend 181 is located at the open end (top) of the first tube 585.

The second tube 586 extends in a second, opposing, airflow direction, downwards (away from the mouthpiece) and surrounds the first tube 586 to create an annular space radially outside the first tube 585 but inside the second tube 586. The second tube is closed at the top, thereby in effect creating the first bend 181, and open at the bottom. After passing the first bend 181, the airflow flows downwards, through the annular space, in the second airflow direction, antiparallel to the first airflow direction, until reaching the lower, open, end of the second tube 586. The airflow now passes (turns) through the second bend 182 to flow in a third airflow direction, generally parallel to the first airflow direction. (It will be appreciated that although FIG. 5 shows the first and third airflow directions as substantially parallel to one another, analogous to the configuration of FIG. 3, the first and third airflow directions could also be inclined to one another, analogous to the configuration of FIG. 4).

Note that in the implementation of FIG. 5, the airflow travels twice along the first tube 585: initially internally, inside the first tube 585, and secondly, after reaching the first bend 181 at the end of the first tube 585, in the opposing direction, externally, in a space external to the first tube 585 (but retained in this space by the second tube 586). The first tube 585 therefore forms a gravitational barrier against liquid following back out of the air passage 130 towards the puff detector 160. The first tube 586 is therefore somewhat analogous to the rim 384 as shown in the implementations of FIGS. 3 and 4, and hence can likewise be regarded as providing or defining a sump region 179.

One advantage of the configuration of FIG. 5 (compared, say, with the configuration of FIG. 3) is that it helps to increase robustness in preventing leakage even if there is movement of the e-cigarette. For example, in the configuration of FIG. 3, if the device is turned about a horizontal axis perpendicular to the plane of the drawing (i.e. into the page), and there is a first rotation of 180 degrees clockwise, followed by a second rotation of 180 degrees anti-clockwise, this will generally cause liquid to flow (leak) from sump 179, through the convoluted portion 180, and down towards the puff detector 160. In contrast, if the configuration of FIG. 5 is subject to the same movement, the liquid will generally flow into the second tube 586 for the first rotation—but for the second rotation, the liquid will then generally flow back on the outside of the first tube 585, in other words, back into the base of the air passage 130 and trap 179.

Accordingly, the configuration of FIG. 5, in particular the convoluted section 180 comprising partially overlapping first and second tubes 585, 586, can be seen as a form of valve having a directional preference or asymmetry. In particular, it is harder for liquid to flow upstream through this configuration than to flow downstream (in contrast, the wall or rim 384 provides a potential energy barrier which may be regarded as symmetric in both upstream and downstream directions). The asymmetry in FIG. 5 can be seen to arise because traveling downstream, the flow passes firstly through the inner (first) tube 585, and then through the outer (second) tube 586, whereas upstream the flow passes firstly through the outer tube 586 and then through the inner tube.

Note that the context of e-cigarette 100 is different from many valve implementations, in that the configuration of FIG. 5 must impede the upstream flow of liquid, while simultaneously supporting the downstream flow of air in response to a user inhalation. The configuration of FIG. 5 provides such simultaneous support, unless the accumulated liquid becomes sufficiently deep so as to close off the end of first or second tube. However, such blocking can generally be avoided, for example, by providing sufficient clearance at the end of each of the first and second tubes, having regard to the likely rate of leakage within the device 100.

Figure 6:
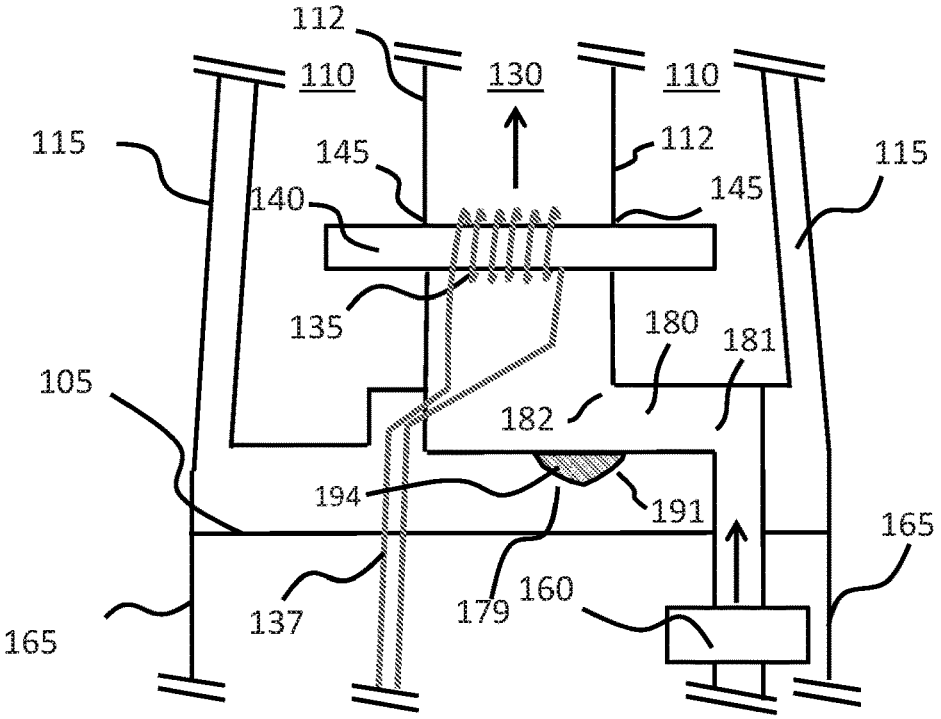
FIG. 6 is a schematic cross-section of a portion of another vapor provision device similar to that shown in FIG. 1, and including a convoluted air pathway and a bowl or depression to act as a sump.

Referring now to FIG. 6, this again schematically shows a cross-section of a portion of an electronic cigarette. Many aspects of FIG. 6 match corresponding aspects of FIGS. 2, 3, 4 and/or 5, and hence are not described in detail again in the interest of brevity. In particular, the convoluted section 180 of the air passage (airflow channel) 130 shown in FIG. 6 is generally similar to the example of FIG. 2. However, unlike the example of FIG. 2, the implementation of FIG. 6 includes a sump or trap 179 to help prevent the leakage of liquid from the air passage 130. Note that in the implementation of FIG. 6, the sump is not formed in conjunction with the convoluted section 180 (such as by forming a rim or lip 384), but rather by forming a bowl or dip 191 (or other form or shape of depression) in the base or floor of the air passage 130. The depression 191 acts to retain liquid that forms or travels upstream of the vaporizer 135, and is located so that in normal use, and holding the e-cigarette in a standard orientation, gravity acts to retain the liquid in the bowl 191, rather than allowing the liquid to proceed further upstream. Accordingly, the depression 191 is formed in a surface of the air passage 130 that would normally act as a base or floor for the airflow channel during normal use. Thus the positioning of the depression 191 shown in FIG. 6 is by way of example, and the depression 191 could, for example, be moved to the left or right of the location shown in FIG. 6. In some implementations, the depression 191 may be located approximately underneath the vaporizer 135 (according to the normal orientation of the device in use) to help increase the likelihood that any liquid leakage from the vaporizer 135 or wick 140 falls or runs into the depression 191.

In some implementations, the sump 179 may be provided with an absorbent material 194 to aid retention of liquid in the depression. For example, during or after use, a user may change the orientation of the device 100 by tilting, such that the mouthpiece 118 is no longer uppermost, thereby potentially allowing the liquid to flow out of the depression 191 under gravity. In these circumstances, the absorbent material may help to retain at least some of the liquid in the sump 179, for example, by osmotic pressure or such like, rather than allowing the liquid to flow freely out of the sump. The absorbent material may comprise a porous and/or hydrophilic material, for example, a sponge or foam material or similar.

In addition, the absorbent material may facilitate the dissipation or evaporation of liquid, for example, by increasing the effective area of the liquid-air interface. It will be appreciated that such dissipation helps to reduce leakage, firstly because evaporated liquid frees up new capacity in the absorbent material, and secondly because once liquid has evaporated, there is no longer any risk of such liquid escaping the absorbent material (as liquid)—for example, perhaps when the e-cigarette is subject to sudden movement, such as being dropped.

Locating the absorbent material 194 in the sump 179 provides an efficient use of space. Furthermore, such a location allows the absorbent material to help retain liquid that accumulates in the sump 179 even when the e-cigarette is tilted significantly (thereby potentially allowing liquid to flow out of the sump 179). However, in some implementations, the absorbent material might be in another location, separate from sump 179 (and/or from convoluted section 180).

The sump 179 may be designed to have a volume capacity of between 2% and 50%, more typically between 5% and 15%, of the volume capacity of the liquid reservoir 110. For example, the liquid reservoir 110 may have a capacity of 2 ml and the sump 179 may have a capacity of approximately 0.2 ml. This sizing of the sump reflects the fact that the liquid only gradually leaves the reservoir, and also the majority of this liquid is likely to be vaporized by the heater 135. Note also that the sump is intended to prevent (or reduce) liquid leakage from or within the device. There may be a gradual evaporation of liquid from the sump, with the resulting vapor then escaping from the device, for example through mouthpiece 118. However, this slow escape of vapor from the device will generally not be noticeable (or detrimental) to the user. Certain absorbent materials 194 (if utilized) may be able to retain a larger volume of water than their own volume. In some cases, the absorbent material may extend slightly above or out of the depression 191, in effect, above the floor or base of the airflow channel 130 and still retain the liquid. The absorbent material may also be utilized to retain or trap liquid even in the absence of any sump or depression.

Figure 7:
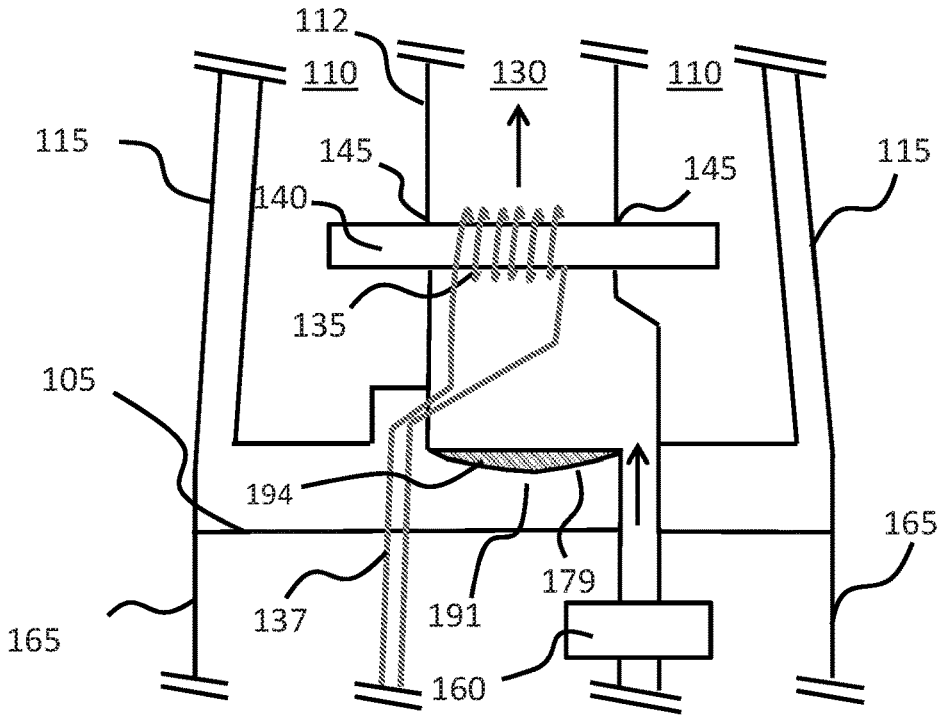
FIG. 7 is a schematic cross-section of a portion of another vapor provision device similar to that shown in FIG. 1, and including a bowl or depression to act as a sump.

Referring now to FIG. 7, this again schematically shows a cross-section of a portion of an electronic cigarette. Certain aspects of FIG. 7 match corresponding aspects of FIG. 6 and hence are not described in detail again in the interest of brevity. In particular, the implementation of FIG. 7 includes a depression 191 to act as a sump 179, as described above in relation to FIG. 6; however, the implementation of FIG. 7 does not include a section of convoluted airway (such as section 180 in the implementation of FIG. 6). In the implementation of FIG. 7, the sump 179 is positioned at the upstream end of the airflow channel 130 to help retain liquid travelling upstream from the vaporizer. The sump 179 of FIG. 7 is again filled with absorbent material to aid such retention of liquid.

Referring now to FIG. 8, this again schematically shows a cross-section of a portion of an electronic cigarette. Certain aspects of FIG. 8 match corresponding aspects of FIGS. 1-7 and hence are not described in detail again in the interest of brevity. In particular, the implementation of FIG. 8 includes tube 585 extending across interface 105 from the reusable portion into the cartridge or cartomizer portion. The region of the cartridge 587 surrounding the tube 585 may be suitably resilient to maintain a tight seal around the tube 585 to prevent unwanted liquid or vapor (or air) leakage. The tube forms part of the main airflow channel 130, and helps to define a convoluted section 180 as described above. Note that the particular configuration of FIG. 8 can also be considered to act as a valve against the upstream flow of liquid (while permitting the downstream movement of air), in a similar manner to the implementation of FIG. 5. The implementation of FIG. 8 further includes a sump 179, provided by the lip or barrier 384 formed by tube 585 (part of the convoluted section 180) together with depression 191. In addition, the depression 191 is also provided with an absorbent material 194.

Figure 8:
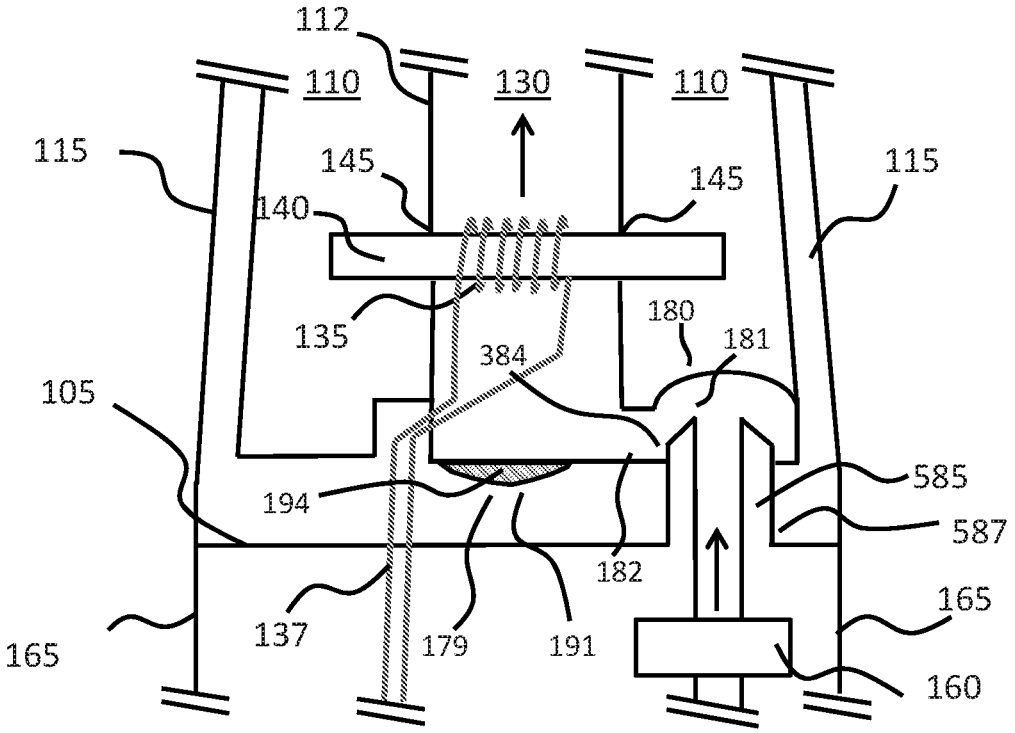
FIG. 8 is a schematic cross-section of a portion of another vapor provision device similar to that shown in FIG. 1, and including a convoluted air pathway and a bowl or depression to act as a sump.

FIG. 8 therefore illustrates how different components or elements may be combined to trap or retain liquid travelling upstream from the vaporizer. For example, the implementation of FIG. 8 can be considered as providing a multi-component trap for liquid, the trap comprising: a first component acting as a gravitational (potential energy) barrier, formed from both dip 191 and wall 384; a second component acting as a valve (as described above) formed by the convoluted section 180; and a third component comprising the absorbent material 194.

Note that these different components work in a complementary or synergistic manner. Thus the first component (the gravitational barrier) is generally very effective, providing the e-cigarette is maintained in a conventional orientation. On the other hand, the absorbent material 194 is able to help retain liquid through osmotic pressure or similar (such as hydrophilic attraction) irrespective of orientation. In addition, the absorbent material may facilitate the dissipation or evaporation of liquid, thereby helping to maintain capacity in the absorbent material, and also in the sump 179 (for implementations in which the absorbent material is located in the sump). Furthermore, even if liquid does escape (leak) from such absorbent material 194 in the configuration of FIG. 8, such liquid is still impeded by the valve formed by the inner tube 585, which again does not require a normal (vertical) orientation to be effective. It will be appreciated that such multiple components therefore support one another in helping to prevent, or at least to reduce, leakage. Such reduction in leakage may be beneficial, for example, to help protect internal components, to help reduce the risk of any negative user experience, and so on.

Accordingly, a vapor provision device as disclosed herein comprises a primary airflow path, internal to the vapor provision device, from an air inlet to an air outlet, wherein air is drawn from the air inlet in a downstream direction through the primary airflow path to the air outlet by user inhalation. The device further comprises a vaporizer for providing vapor into the primary airflow path, wherein the vaporizer is located within or adjacent to the primary airflow path, and a trap located in the primary airflow path, upstream of the vaporizer, to retain liquid by inhibiting the flow of liquid along the primary airflow path in (at least) an upstream direction from the trap. (In some cases the trap may also help to inhibit flow in a downstream direction as well).

The trap may be based on utilizing some form of gravity (potential energy) barrier, which may be provided, for example, by a sump and/or a convoluted portion of the primary airflow path. The sump itself may be provided, for example, by a suitable depression or bowl formed in a wall (e.g. base) of the primary airflow path, and/or by a wall, rim, barrier or such like (which may typically be formed as part of the convoluted portion).

Additionally or alternatively, the trap may utilize some form of absorbent material, such as foam or sponge, to trap or retain liquid—for example on the basis of osmotic pressure, hydrophilic or similar. The absorbent material also may be located in a sump to provide additional retention capability. It will be appreciated that the better the liquid retention, the greater the expected reduction in leakage. In addition, the liquid retention is achieved without blocking or significantly reducing airflow through the device (which might otherwise prevent or degrade usage of the device).

The trap described herein helps, inter alia, to retain liquid produced by or in the vicinity of the vaporizer, thereby preventing such liquid from travelling upstream where it might contaminate or incapacitate a puff sensor (for example). This is supported by having the trap located relatively close to the vaporizer, e.g. within a line of sight, and/or within a distance of say 5, 10, or 15 mm.

In some implementations, the convoluted portion may comprise first and second bends (the first bend being upstream of the second bend), a first flow section (between the first and second bends) and a second flow section (immediately downstream of the second bend). The first flow section is higher than the flow second section when the device is held in a normal orientation for user inhalation (typically with the mouthpiece uppermost). It will be appreciated that this difference in height provides a potential barrier to help prevent or inhibit liquid flow from second section to the first section (i.e. in the upstream direction).

The use of such a gravity barrier is dependent at least in part on the orientation of the device. One way of addressing this is to include a valve configuration in the primary airflow path, for which upstream flow is more difficult that downstream flow. Another way of addressing this is to utilize an absorbent material to retain (or to help retain) liquid, since the absorption of the material is effective independent of orientation (although liquid retained by the material is still of course subject to gravity).

The trap described herein has little or no effect on the downstream flow of air, since this downstream path must remain open to support user inhalation. One way of quantifying this is based on resistance to draw (RTD), which can be expressed in terms of the pressure difference required to pull (inhale) air through the e-cigarette at a given flow rate—e.g. 17.5 milliliters per second, see ISO 3402. The trap described herein generally changes the RTD by less than 20%, for example 15%, for example less than 10%, for example less than 5%, for example less than 2% (compared with an e-cigarette without the trap).

The approach described herein can be utilized in a vapor provision device that forms a complete system, such as an e-cigarette, and likewise in a vapor provision device that forms a part or component of such a complete system. For example, in the latter situation, the vapor provision device may represent a cartridge or cartomizer.

The above-described embodiments represent specific example vapor provision systems and devices, but it will be appreciated the same principles as disclosed herein can be applied for vapor provision systems and devices using other technologies. For example, while FIG. 1 shows the air inlet 170 and the puff sensor 160 as components of the reusable portion 101, but one or both of the air inlet 170 and the puff sensor may be components of the cartridge 102. Similarly, although the above-described implementations have primarily focused on vapor provision systems and devices having a resistance heater coil as a vaporizer, in other examples the vaporizer may comprise another form of heater, for example a planar heater, in contact with a liquid transport element. Furthermore, in other implementations a vaporizer might be inductively heated, or might use other vaporization technologies (rather than heating), such as piezoelectric excitement to generate the vapor. In addition, and as already noted, the above-described embodiments have focused on a vapor provision system comprising a two-part device. Nevertheless, the same principles may be applied in respect of other forms of aerosol or vapor provision system which do not rely on replaceable cartridges, for example refillable or one-time use devices. Moreover, although the above-described embodiments include a solid material chamber 120, the approach described herein can be utilized in devices which do not utilize solid material in this manner.

Overall, in order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. It will be appreciated that features and aspects of the disclosure described herein in relation to particular implementations may be combined with features and aspects of other implementations, as appropriate, and not just in the specific combinations described above. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A vapor provision device comprising:

a primary airflow path, internal to the vapor provision device, from an air inlet to an air outlet, wherein air is drawn from the air inlet in a downstream direction through the primary airflow path to the air outlet by a user inhalation;

a vaporizer for providing vapor into the primary airflow path, wherein the vaporizer is located within or adjacent to the primary airflow path;

a wick for transporting liquid from a reservoir to the vaporizer;

a trap located in the primary airflow path to inhibit liquid flow along the primary airflow path in an upstream direction from the trap, wherein the trap is separate from the vaporizer; and an airflow sensor for detecting the user inhalation on the vapor provision device, wherein the trap is located downstream of the airflow sensor and upstream of the vaporizer and the wick on the primary airflow path, wherein the trap comprises one or more of the following:

an absorbent material for liquid retention;

a sump or depression forming a gravitational barrier to inhibit liquid flow in the upstream direction when the vapor provision device is held in a normal orientation for the user inhalation; and a valve configuration to inhibit liquid flow upstream compared with liquid flow downstream.

2. The vapor provision device of claim 1, wherein the absorbent material located within the sump or depression, according to the normal orientation of the vapor provision device for the user inhalation.

3. The vapor provision device of claim 2, wherein the primary airflow path is substantially a straight line from the vaporizer to the absorbent material.

4. The vapor provision device of claim 2, wherein the absorbent material facilitates evaporation from within the vapor provision device.

5. The vapor provision device of claim 1, wherein the vapor provision device is configured to contain or receive the reservoir of liquid to be vaporized, and wherein the trap has a capacity to retain between 2% and 30% of a volume of the reservoir.

6. The vapor provision device of claim 1, wherein the vapor provision device comprises a cartomizer for connection to a reusable component for supplying power to the vapor provision device.

7. The vapor provision device of claim 1, wherein the trap has substantially no effect on a downstream flow of air resulting from the user inhalation.

8. A vapor provision device comprising:

a primary airflow path, internal to the vapor provision device, from an air inlet to an air outlet, wherein air is drawn from the air inlet in a downstream direction through the primary airflow path to the air outlet by the user inhalation;

a vaporizer for providing vapor into the primary airflow path, wherein the vaporizer is located within or adjacent to the primary airflow path;

a wick for transporting liquid from a reservoir to the vaporizer; and a multi-component trap located in the primary airflow path to inhibit liquid flow along the primary airflow path in an upstream direction from the trap, wherein the trap is located upstream and separate from the vaporizer and the wick on the primary airflow path, wherein the multi-component trap comprises:

a gravitational barrier to inhibit liquid flow in the upstream direction when the vapor provision device is held in a normal orientation for the user inhalation; and an absorbent material for retaining liquid.

9. The vapor provision device of claim 8, further comprising a valve configuration to inhibit liquid flow upstream compared with liquid flow downstream.

10. A vapor provision device comprising:

a primary airflow path, internal to the vapor provision device, from an air inlet to an air outlet, wherein air is drawn from the air inlet in a downstream direction through the primary airflow path to the air outlet by the user inhalation;

a vaporizer for providing vapor into the primary airflow path, wherein the vaporizer is located within or adjacent to the primary airflow path;

a wick for transporting liquid from a reservoir; and a trap located in the primary airflow path to inhibit liquid flow along the primary airflow path in an upstream direction from the trap, the trap being located upstream and separate from the vaporizer and wick on the primary airflow path.

* * * * *